US005524513A

United States Patent [19]

Barahona

[11] Patent Number: 5,524,513

[45] Date of Patent: Jun. 11, 1996

[54] MULTIPURPOSE IN-LINE SKATE WHEEL AND BEARING TOOL

[76] Inventor: Ralph J. Barahona, 4608 Bellflower Blvd., Lakewood, Calif. 90713

[21] Appl. No.: 438,022

[22] Filed: May 8, 1995

[51] Int. Cl.[6] ..... B25B 22/00

[52] U.S. Cl. ..... 81/439; 81/125.1; 81/177.4; 7/165

[58] Field of Search ..... 81/437–439, 125.1, 81/177.4, 490; 7/138, 165, 170

[56] References Cited

U.S. PATENT DOCUMENTS

| | | | |
|---|---|---|---|
| 2,735,325 | 2/1956 | Rudd, Sr. | 81/71 |
| 2,822,714 | 2/1958 | Paparelli | 81/71 |
| 2,933,963 | 4/1960 | Blasdell | 81/71 |
| 3,127,798 | 4/1964 | Gol | 81/71 |
| 4,372,361 | 2/1983 | Whiteford | 81/177.4 |
| 4,448,097 | 5/1984 | Rocca | 81/177 M |
| 4,699,030 | 10/1987 | Yang | 81/440 |
| 5,018,411 | 5/1991 | La Padura | 81/57.5 |
| 5,186,083 | 2/1993 | Hsiao | 81/125.1 X |
| 5,251,341 | 10/1993 | Seals | 7/138 |
| 5,313,680 | 5/1994 | Ringler | 7/138 |
| 5,355,574 | 10/1994 | Zweekly et al. | 29/262 |
| 5,365,811 | 11/1994 | Chi | 81/439 |
| 5,369,864 | 12/1994 | Hill | 29/271 |

FOREIGN PATENT DOCUMENTS

| | | |
|---|---|---|
| 512424 | 5/1955 | Canada . |
| 3744176 | 8/1989 | Germany . |

*Primary Examiner*—D. S. Meislin
*Attorney, Agent, or Firm*—Frank J. McGue

[57] ABSTRACT

A tool is disclosed for use in removing a wheel and bearings of an in-line skate. The skate has a trough-shaped frame mounted thereon while the wheel has a hub with two bearings mounted therein. The two bearings have an inner diameter and are separated by a hollow spacer mounted therebetween. The wheel is mounted in the trough shaped frame with allen hardware extending through the frame and into the hollow spacer.

The tool comprises a handle having two ends. The handle includes a first cavity extending longitudinally therein from one end of the handle with an allen wrench corresponding to the allen headed bolt or screw detachably mounted within the first cavity. Three concentrically mounted, staggered levels having differing diameters extend longitudinally from the handle end opposite the cavity. The first level abutting said handle is larger than the inner diameter of the bearings. The second level abutting the first level has a diameter greater than the hollow spacer but less than the inner diameter of the bearing. The third level abutting the second level has a diameter less than that of the hollow spacer. Mounted on the third level opposite the handle is an allen wrench tip corresponding to the allen headed bolt.

9 Claims, 2 Drawing Sheets

MULTIPURPOSE IN-LINE SKATE WHEEL AND BEARING TOOL

TECHNICAL FIELD

This invention relates to a device for use in connection with the wheels and bearings of in-line skates, and, more particularly, for a single hand held combination device which allows the user to easily remove and reattach the wheels, bearings, spacers and/or axles from a in-line skate for maintenance, replacement and repair.

BACKGROUND OF THE INVENTION

In-line skating has become a popular form of exercise and entertainment in recent years. At present, in addition to recreational use, organized events exist wherein professional and amateur in-line skaters compete.

The combination of the in-line wheels with the supporting axles and bearings is critical for performance. As with any system of moving parts, such components will wear out and thus will periodically need replacement. In addition, most manufacturers recommend rotation of the wheels with periodic oiling or greasing of the bearings for optimum performance. At the professional or advanced amateur level, wheels of differing hardness or durometer reading are used for various surfaces ranging from street pavement to indoor tracks. Thus, removal of such wheel and bearings for the above tasks and purposes is a continuing need in the sport.

DESCRIPTION OF THE PRIOR ART

Presently, skaters will use a plurality of devices to separate the wheel components for replacement and repair. To remove the wheel from the skate, allen wrenches are employed to disengage the wheel from the skate support frame. A variety of tools supplied by bearing manufacturers can be used to push or pull the bearing, and related components such as a spacer and/or axle from the wheel.

U.S. Pat. No. 5,365,811 discloses a multi-purpose skate tool having a three armed star structure from which metal tool tips extend.

U.S. Pat. No. 5,355,574 discloses a bearing changer for in-line skates having a retractable conically headed rod.

U.S. Pat. No. 5,369,864 discloses a tool kit having an assemblage of parts for aligning and installing a ball bearing on in-line skates.

U.S. Pat. No. 4,448,097 discloses a driver tool using multiple levels of allen wrenches.

U.S. Pat. Nos. 2,735,325, 2,822,714 and 3,127,798 disclose telescoping allen wrenches.

German Patent No. 3744176A1 discloses an allen wrench handle having a second allen wrench.

U.S. Pat. Nos. 2,933,963, 4,699,030, and 5,018,411 disclose multiple headed allen wrenches.

The known prior art is described above. None of the known prior art disclose the device set forth herein.

SUMMARY OF THE INVENTION

It is an object of this invention to provide a combination device for separating and reassembling the wheel components of an in-line skate quickly and easily.

It is a further object of this invention to provide a single hand held combination device for separating the wheel components of an in-line skate.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 6:
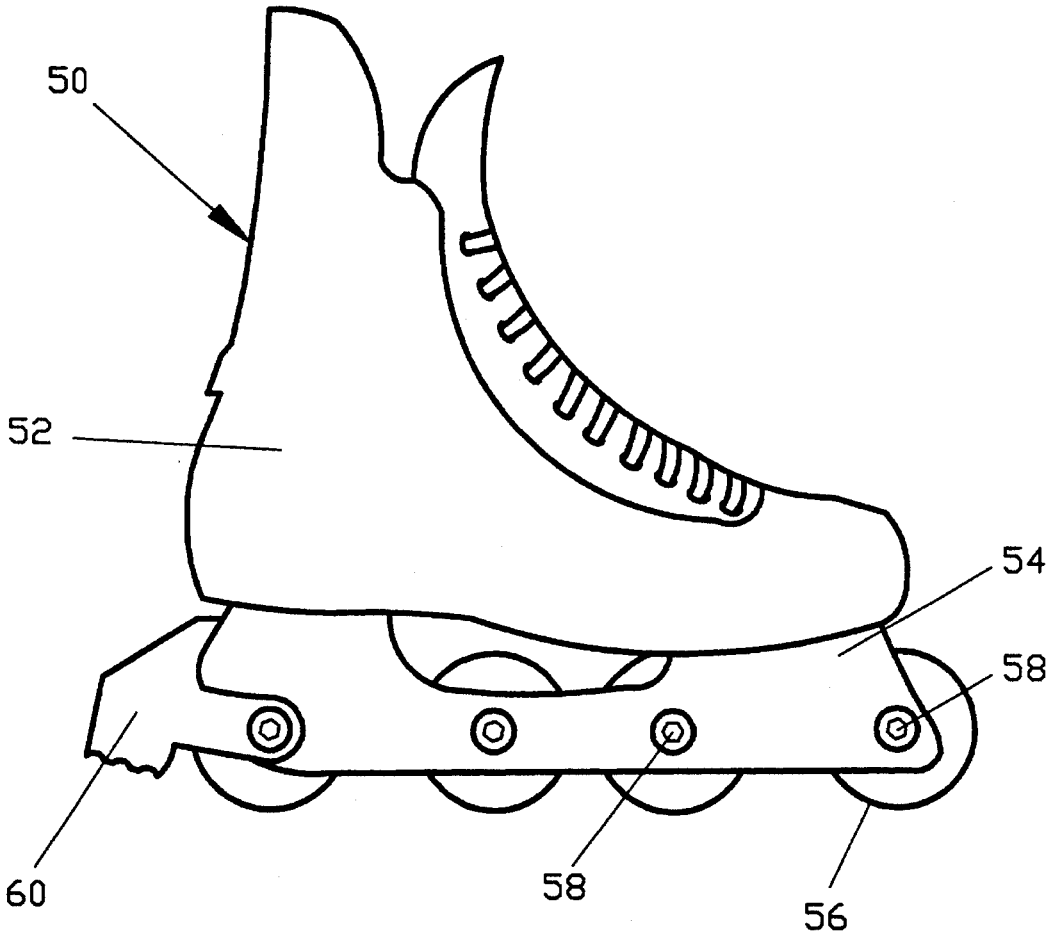
FIG. 6 is a side view of an in-line skate.
Figure 7:
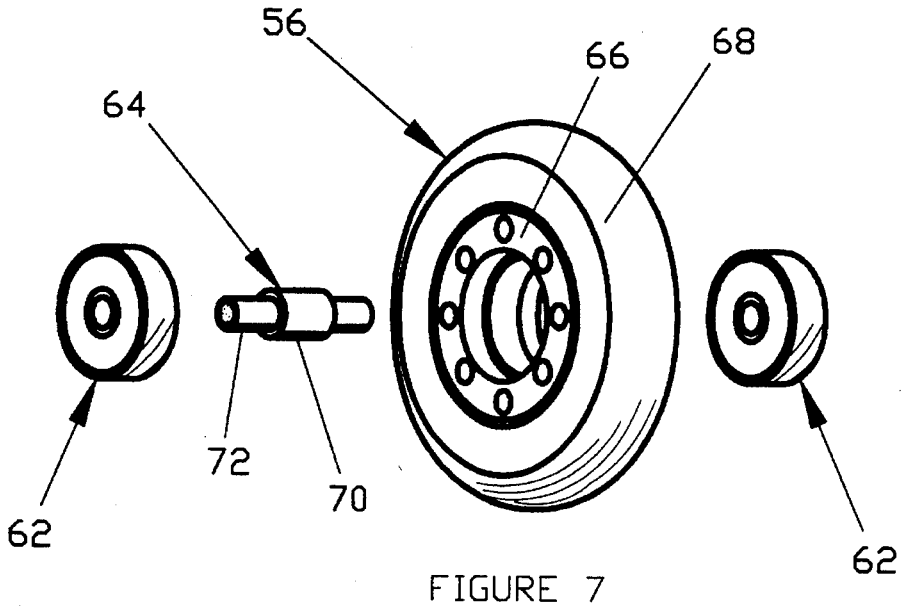
FIG. 7 is an exploded view of a wheel for an in-line skate.

Referring more particularly to the drawings by characters of reference, FIGS. 6–7 show an in-line skate 50. Skate 50 comprises a boot 52 and a frame 54 which is attached to the bottom of boot 52. Frame 54 is trough-shaped with a plurality of wheels 56 mounted within the trough.

Some combination of allen headed bolts, screws and nuts, collectively allen hardware 58, extend through one side of frame 54 to engage either wheel 56 or related elements thus securing each wheel 56 to frame 54 in a manner well known in the art. In general, hardware 58 has either 1/8 inch, 5/32 inch or 4 millimeter allen heads. In addition, a brake 60 is generally mounted via allen hardware at the rear of the frame 54.

Referring now to FIG. 7, wheel 56 is shown with related elements being two bearings 62 and a spacer 64. Wheel 56 is generally comprised of a open hub 66, a nylon core (not shown) which is surrounded by an exterior 68 of polyurethane. Wheel 56 is measured by its durometer reading (hardness), diameter, and weight. Wheel selection is dependent on the weight and end use of the skater, the road surface and conditions, and the speed and maneuverability desired. Road surfaces can be all the varieties of pavement as well as plastic or wood indoor tracks.

The illustrated bearings 62 having an inner diameter are mounted within the hub 66 of wheel 56 with proper separation being maintained by spacer 64. In the example illustrated, spacer 64 includes a center portion 70 which maintains the separation and two end portions 72 upon which the bearings 62 are mounted. Spacer 64 is hollow which allows the bolts and/or screws 58 to extend therethrough to mount wheel 56 to frame 54. Frame 54 holds bearings 62 within the wheel 56.

Those skilled in the art will recognize that many other configurations and combinations of wheel, spacer, axle are used in the industry. For example, some varieties of spacer 64 are internally threaded which threading allen hardware 58 engages to mount spacer 64 and wheel 56 to frame 54. In another variation, center portion 70 is hex shaped and includes an internal allen nut for engagement of allen bolts and screws 58. In still another variation, spacer 64 does not include a center portion 70 but instead is the same outer diameter through the entire length.

Referring now to FIGS. 1–5, a tool or device 10 is shown having a handle 12, handle 12 including a first cavity 14 extending longitudinally therein from one end of handle 12 thereof, and a plurality of concentrically mounted, cylindrically shaped, staggered first level 18, second level 20, and third level 22 separated by shoulders 19 and 21 thereby having a telescopic appearance of differing diameters extending longitudinally from handle 12 opposite cavity 14. As understood by those skilled in the art, device 10 can be manufactured from any suitable material such as aluminum, steel or plastics such as ABS, polycarbonate or glass-filled nylon.

A stepped down level 16 intermediate between 7/16 and ¾ of an inch in diameter is optionally provided in the illustrated embodiment. Level 16 functions as a portion of handle 12. The thicker portion of handle 12 is preferably between ¾ and 27/32 of an inch in diameter and includes knurl sections 32 which provide a firm gripping surface for a user. Alternatively, grooves or simply flat sides could be employed.

Figure 1:
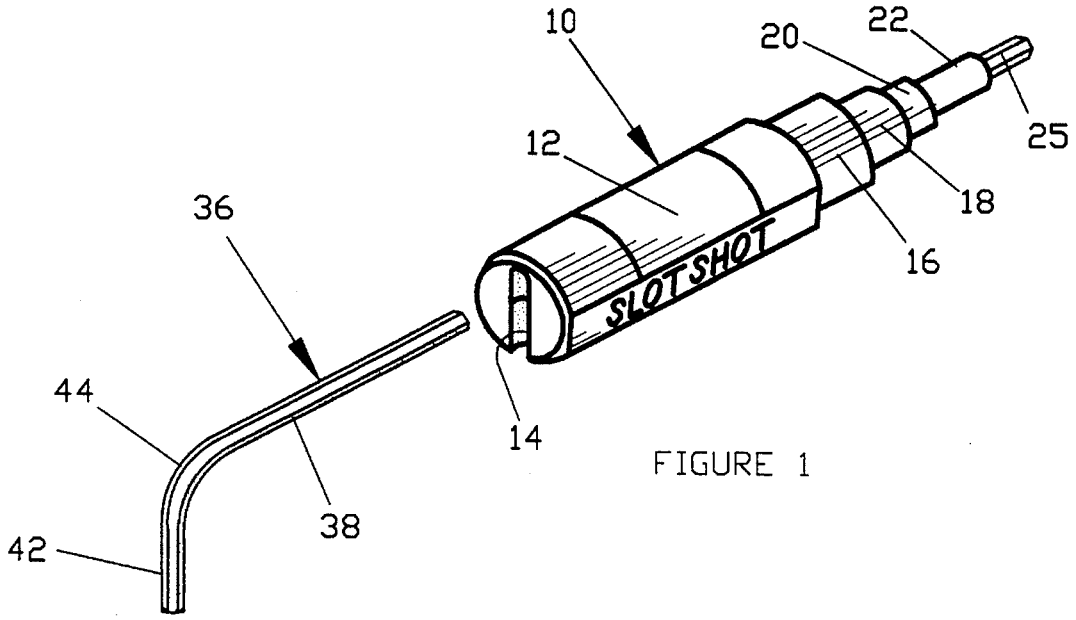
FIG. 1 is a perspective view of the present invention.
Figure 5:
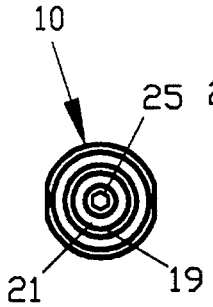
FIG. 5 is a front view of FIG. 1.
Figure 2:
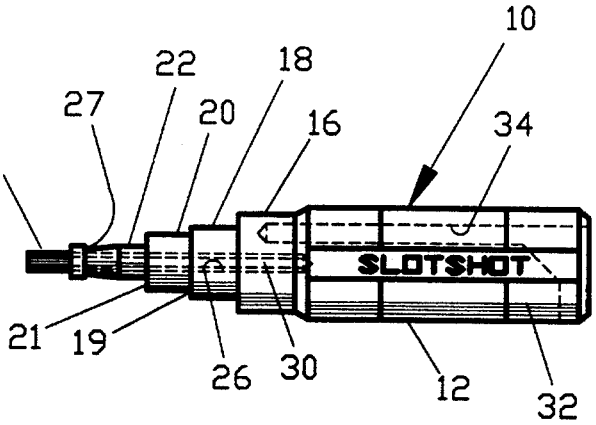
FIG. 2 is a side view of an alternate embodiment of the present invention.
Figure 3:
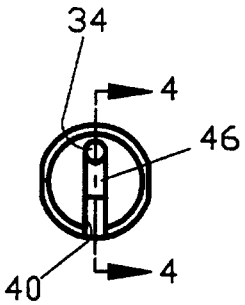
FIG. 3 is a rear view of FIG. 1.
Figure 4:
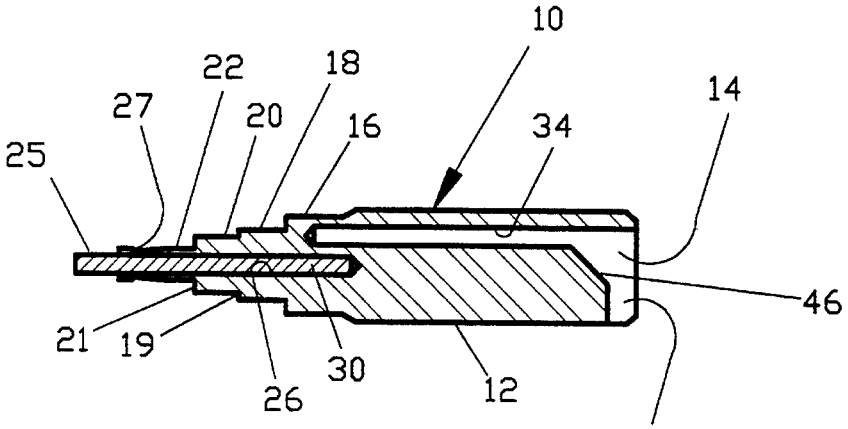
FIG. 4 is a cross-sectional side view of FIG. 3 taken along line 4—4.

As best seen in FIGS. 1, 2 and 4, a allen wrench tip 25, is mounted to third level 22 opposite handle 12. Tip 25 is either ⅛ inch, 5/32 inch or 4 millimeter, which sizes correspond to the most common screw sizes for the hardware 58 which secures the wheel to the frame of the skate. In the presently preferred embodiment, allen wrench tip 25 is permanently mounted within a second cavity 26 which extends preferably between ¾ to 2 inches into device 10 whereby allen wrench tip 25 extends outwardly from third level 22 approximately ⅛ to ¼ of an inch.

However, in an alternate embodiment allen wrench tip 25 includes wrench tip 25 and a mounting portion 30. Wrench tip 25 extends outward from level 22 approximately ⅛ to ¼ of an inch. Mounting portion 30 is detachably mounted within cavity 26. This embodiment allows wrench tips 25 of differing sizes to be mounted to a standardized mounting portion 30 and interchanged as needed. Such extra tips 25 could be stored, for example, in a cap covered third cavity (not shown) in handle 12.

Third level 22 fits within the hollow interior of spacer 64 mounted within wheel 56 and bearings 52 as previously described. Third level 22 is preferably 7/32 to ¼ inch in diameter and ½ inch in length. When reassembling the wheel 56 into frame 54, third level 22 may also be inserted into holes in frame 54 corresponding to the locations of allen hardware 58 to align the interior of spacer 64 and said holes for easy insertion of allen bolt or screw 58 therein.

When third level 22 is inserted into spacer 64, the diameter of second level 20 is large enough whereby shoulder 21 will engage spacer 64 extending through one bearing 62 but small enough whereby second level 20 fits within the inner diameter of bearing 62. Second level 20 is preferably 5/16 inch in diameter and 9/32 to ⅜ of an inch in length.

Thus, shoulder 21 engages spacer 64 whereby force exerted on tool 10 is transmitted to center portion 70 of spacer 64 and thus pushes out opposing bearing 62 and spacer 64 from the wheel 56. After removal of one of bearings 62, wheel 56 is reversed whereby device 10 is inserted into wheel 56 from the opposing side. When so inserted, second level 20 fits within the inner diameter of remaining bearing 62.

When the tool is reversed as described with second level 20 fitted within the inner diameter of the remaining bearing, the diameter of first level 18 is larger than the inner diameter of remaining bearing 62 so that shoulder 19 will engage the inner seal of the remaining bearing 62 to push it out of wheel 56 without causing harm thereto. Level 18 is preferably 7/16 of an inch in diameter and ¼ to 5/16 of an inch in length.

In an alternate embodiment shown in FIG. 2, a notch 27 is provided in level 22. After removal of one bearing 62 and spacer 64, tool 10 is tipped whereby notch 27 engages with and pulls out remaining bearing 62 when withdrawing device 10 from wheel 56.

This particular embodiment is also useful for those spacers 64 which do not include a center portion 70. To use, the spacer is first forced from the wheel and then the notch 27 is used to engage each bearing individually to pull from the wheel.

As best seen in FIG. 4, opposite levels 16 through 22, first cavity 14 is preferably L-shaped with a long leg 34 of the L extending off center into handle 12 a distance corresponding to the length of a standard allen wrench 36. In the preferred embodiment, allen wrench 36 is either ⅛ inch, 5/32 inch or 4 millimeter having long leg 38 length of 2⅛ inch.

A short leg 40 of the L is an open configuration which is slightly undercut to snap fit a short leg 42 of the allen wrench therein. When inserted into cavity 14, short leg 42 of allen wrench 36 extends beyond the device 10 thereby allowing easy removal therefrom. In addition, a user can insert short leg 42 of allen wrench 36 into long leg 34 of cavity 14 whereby long leg 38 extends out of short leg 40 laterally from device 10 to provide added leverage for removal of stubborn bolts and screws.

To accommodate standard allen wrenches which include an arcuate section 44 joining the two legs 38 and 42, first cavity 14 includes a shoulder portion 46 which joins the long leg 34 and the short leg 40. In the preferred embodiment, shoulder portion 46 is an angle cut of 45 degrees. Alternatively, shoulder portion 46 is a curved contour matching the arcuate section 44.

It will be understood by those skilled in the art that allen wrench 36 can be mounted to tool 10 by alternate means such as on the exterior of tool 10.

The standard allen wrench 36 is used in conjunction with allen wrench tip 25 to engage two opposing allen bolts and screws on a skate if needed. Such opposing allen hardware 58 often occurs with the use of the threaded spacer 64 previously described. Quite often, such hardware 58 becomes difficult to remove due to the environment to which they are exposed. Thus, leveraging from both sides is often helpful in securing removal of the wheel.

Tool 10 is also useful in actually removing frame 54 from boot 52. Often, allen hardware is used to secure the frame 54 from boot 52. Tool 10 is small enough to fit within the trough shaped frame 54 and engage the attaching hardware for removal or reattachment thereof.

Although only certain embodiments have been illustrated and described, it will be apparent to those skilled in the art that various changes and modifications may be made therein without departing from the spirit of the invention or from the scope of the appended claims. For example, it is contemplated that handle 12 may incorporate a ratcheting mechanism (not shown) to allow easier removal of allen hardware.

What is claimed is:

1. A tool for use in removing a wheel and bearings of an in-line skate, the skate having a trough-shaped frame mounted thereon, the wheel having a hub with two bearings mounted thereon, the two bearings having an inner diameter and being separated by a hollow spacer mounted therebetween, the wheel being mounted in the trough shaped frame with an allen headed bolt extending through the frame and the hollow spacer, the tool comprising:

a handle having two ends, one of the ends having a cavity;

an allen wrench corresponding to the allen headed bolt detachably mountable in the cavity; and three concentrically mounted, staggered cylindrically shaped levels having differing diameters extending longitudinally from the handle opposite the cavity, the first level abutting said handle being larger than the inner diameter of the bearings, the second level abutting the first level, the second level having a diameter greater than the hollow spacer but less than the inner diameter of the bearing, the third level abutting the second level, the third level having a diameter less than that of the hollow spacer, the third level including a notch engageable with the inner diameter of a bearing;

an allen wrench tip corresponding to the allen hardware mounted to the third level opposite the handle.

2. The tool of claim 1 comprising aluminum.

3. The tool of claim 1 comprising polycarbonate.

4. The tool of claim 1 wherein the handle includes a first cavity extending longitudinally therein from one end of the handle, said allen wrench being detachably mounted within the first cavity.

5. The tool of claim 1 wherein the third level has a diameter less than that of the allen hardware extending through the frame, the tool being used to align the spacer where the allen hardware extends through the frame.

6. A tool for use in removing a wheel and bearings of an in-line skate, the skate having a trough-shaped frame mounted thereon, the wheel having a hub with two bearings mounted thereon, the two bearings having an inner diameter and being separated by a hollow spacer mounted therebetween, the wheel being mounted in the trough shaped frame with an allen headed bolt extending through the frame and the hollow spacer, the tool comprising:

a handle having two ends, one of the ends having a cavity;

an allen wrench corresponding to the allen headed bolt detachably mountable in the cavity; and three concentrically mounted, staggered cylindrically shaped levels having differing diameters extending longitudinally from the handle opposite the cavity, the first level abutting said handle being larger than the inner diameter of the bearings, the second level abutting the first level, the second level having a diameter greater than the hollow spacer but less than the inner diameter of the bearing, the third level abutting the second level, the third level having a diameter less than that of the hollow spacer;

an allen wrench tip corresponding to the allen hardware mounted to the third level opposite the handle, the allen wrench tip comprising a mounting portion and a tip portion, the mounting portion being mounted in a second cavity, said second cavity opening into the third level.

7. The tool of claim 6 wherein the mounting portion is detachably mountable within the second cavity.

8. The tool of claim 7 further comprising a plurality of allen wrench tips, each tip portion thereof corresponding to allen hardware of differing dimensions, each mounting portion thereof being detachably mounted within the second cavity.

9. The tool of claim 8 further comprising a third cavity in the handle, said third cavity receiving the plurality of allen wrench tips when not in use.

* * * * *